US010780340B2

(12) United States Patent
Carrodine

(10) Patent No.: US 10,780,340 B2
(45) Date of Patent: Sep. 22, 2020

(54) SELF-ALIGNING SNOWBOARD BINDING

(71) Applicant: Jaen Carrodine, Annapolis, MD (US)

(72) Inventor: Jaen Carrodine, Annapolis, MD (US)

( * ) Notice: Subject to any disclaimer, the term of this patent is extended or adjusted under 35 U.S.C. 154(b) by 0 days.

(21) Appl. No.: 16/382,440

(22) Filed: Apr. 12, 2019

(65) Prior Publication Data

US 2019/0314708 A1 Oct. 17, 2019

Related U.S. Application Data

(60) Provisional application No. 62/657,319, filed on Apr. 13, 2018.

(51) Int. Cl.
*A63C 10/06* (2012.01)

(52) U.S. Cl.
CPC ..... *A63C 10/06* (2013.01)

(58) Field of Classification Search
CPC ..... A63C 10/06
See application file for complete search history.

(56) References Cited

U.S. PATENT DOCUMENTS 2,648,884 A 8/1953 Loofboro
5,664,298 A * 9/1997 Nessar-Ivanovic ..... A44C 5/2071 24/303
6,598,271 B2 * 7/2003 Nire ..... A41F 1/002 24/265 WS
7,496,994 B1 * 3/2009 Headley ..... A44C 5/2019 24/303
8,894,075 B2 * 11/2014 Walker ..... A63C 10/145 280/14.24
9,307,808 B1 * 4/2016 Lill ..... A44B 11/2584
9,682,308 B1 6/2017 Reinarz
10,010,783 B2 7/2018 Reinarz
10,085,521 B2 * 10/2018 Chen ..... A44B 11/258
10,206,461 B1 * 2/2019 Swetish ..... B60R 9/08
10,212,993 B2 * 2/2019 Fiedler ..... F16B 1/00
10,376,022 B2 * 8/2019 Duncan ..... H01F 7/0263
10,525,325 B1 * 1/2020 Koppel ..... A63C 10/28
2015/0048597 A1 * 2/2015 Tudor ..... A63C 10/06 280/619
2016/0175689 A1 * 6/2016 Chen ..... A63C 10/24 280/14.21
2019/0314708 A1 * 10/2019 Carrodine ..... A63C 10/06

* cited by examiner

*Primary Examiner* — Bryan A Evans

(57) ABSTRACT

A self-aligning snowshoe binding is provided that simplifies the process of "strapping in" to a snowboard. The binding includes a self-aligning buckle that includes two mating clips, and each clip contains a pair of offset magnets. One clip is rigidly attached to a snowboard binding and the other, mating, clip is connected to an ankle or toe strap via a tensioning mechanism. The opposite side of the ankle/toe strap is secured to the binding with an adjustable mechanism. When the two clips are brought proximate each other, the magnets engage to create a loose buckling. When tension is applied to the engaged clips, the clips interlock such that they will remain together as long as tension in the strap is maintained.

16 Claims, 11 Drawing Sheets

SELF-ALIGNING SNOWBOARD BINDING

RELATED APPLICATION DATA

This application claims the benefit of Provisional Application for Patent Ser. No. 62/657,319, titled "Self-aligning snowboard (SAS) binding," which was filed on Apr. 13, 2018 and is hereby incorporated by reference in its entirety.

FIELD OF THE INVENTION

The present invention generally relates to snowboard bindings. In particular, the present invention is directed to a Self-Aligning Snowboard Binding.

BACKGROUND

A snowboard rider wears boots that fit into manually releasable bindings which are attached to the top surface of the snowboard, analogous to bindings on alpine skis. Regular snowboard bindings use two straps to secure the riders boot to the snowboard. One strap wraps around the heel of the boot and one secures the toe of the boot. These straps are connected, released, and tightened with a ratchet system.

The ratchet system used by regular snowboard bindings requires fine motor skills that may not have developed in younger snowboard riders and may also require two-handed operation. This makes the process of securing one's feet to a snowboard especially difficult for young participants of the sport.

Regular snowboard bindings can also can be confusing for beginners, thus the process of securing one's feet to the snowboard can often be arduous and time consuming. This adds to the already difficult task of learning how to snowboard and can make learning less enjoyable.

A commonly cited disadvantage of snowboarding compared to skiing is that snowboarders must constantly attach and detach their boots to and from their bindings whenever they use the ski lift while skiers do not. This process is time consuming and often means the user must sit in the cold snow while attaching their boots to the binding.

Therefore, a need exists for a novel binding that is easier for young snowboard riders to operate, less confusing for beginners, and faster to attach and detach than regular snowboard bindings.

SUMMARY OF THE DISCLOSURE

In an exemplary embodiment, a snowboard binding is provided that includes a baseplate configured to receive a boot, and a first clip connected to the baseplate, the first clip having a first top face, a first front portion, and a first rear portion, wherein the first rear portion includes a first engagement member extending from the first top face, the first engagement member including a first hook portion, and wherein the first top face includes a first magnet having an outward facing polarity. A second clip has a second top face, a second front portion, and a second rear portion, wherein the second rear portion includes a second engagement member extending from the second top face, the second engagement member including a second hook portion, the second hook portion configured to be an interlocking counterpart to the first hook portion, and wherein the second top face includes a second magnet, the second magnet having an outward facing polarity that is opposite the first outward facing polarity. A tensioning mechanism is connected to the second clip, and a strap is connected to the tensioning mechanism and the baseplate.

In another exemplary embodiment, a clip for a self-aligning snowboard binding is provided that includes a base having a top face, a bottom, a front portion, and a rear portion, wherein an aperture passes through the base from the top face through the bottom. An engagement member extends from the top face proximate the front portion, and includes a first magnet and a hook portion. A second magnet is embedded in the rear portion of the top face, the second magnet having an outward facing polarity that is opposite of an outward facing polarity the first magnet.

In another exemplary embodiment, a method of securing a boot to a snowboard is provided that includes placing a boot onto a baseplate of a binding, the baseplate having a first magnetic clip, and pulling a strap over the boot, the strap having a second magnetic clip and a lever. The first clip is placed proximate the second clip so as to loosely couple the boot to the baseplate, and then the lever is closed so as to secure the boot to the baseplate

BRIEF DESCRIPTION OF THE DRAWINGS

For the purpose of illustrating the invention, the drawings show aspects of one or more embodiments of the invention. However, it should be understood that the present invention is not limited to the precise arrangements and instrumentalities shown in the drawings, wherein.

DESCRIPTION OF THE DISCLOSURE

The self-aligning snowshoe binding of the present invention simplifies the process of "strapping in" to a snowboard through the use of a self-aligning buckle that includes two mating clips, and each clip contains a pair of offset magnets. One clip is rigidly attached to a snowboard binding and the other, mating clip, is connected to an ankle or toe strap via a cam actuated lever or other suitable mechanism. Such mechanisms may include a ratcheting system in which the strap is partially attached to a ratchet and the end of the strap is attached to the top clip, a twist nob configured to tighten the strap, or a looping a strap threaded through the top clip which can be held in a position that keeps tension on the strap by a hook and loop fastener or similar.

The opposite side of the ankle/toe strap is secured to the binding with an adjustable mechanism. When the two clips are brought within about ¼ inch of each other, the magnets engage to create a loose buckle condition. The cam lever is depressed and brought in-line with the ankle/toe straps to tighten the boot into the binding. When the cam lever is depressed, the magnetic clips lock together in a hooking fashion such that they will stay locked together as long as tension in the strap is maintained. The tension can be preset by adjusting the length of the heel or toe strap using an adjustable mechanism on the outboard side of the corresponding ankle/toe strap. Once the preset tension is configured, further changes to the adjustable mechanism are generally not required.

Figure 1:
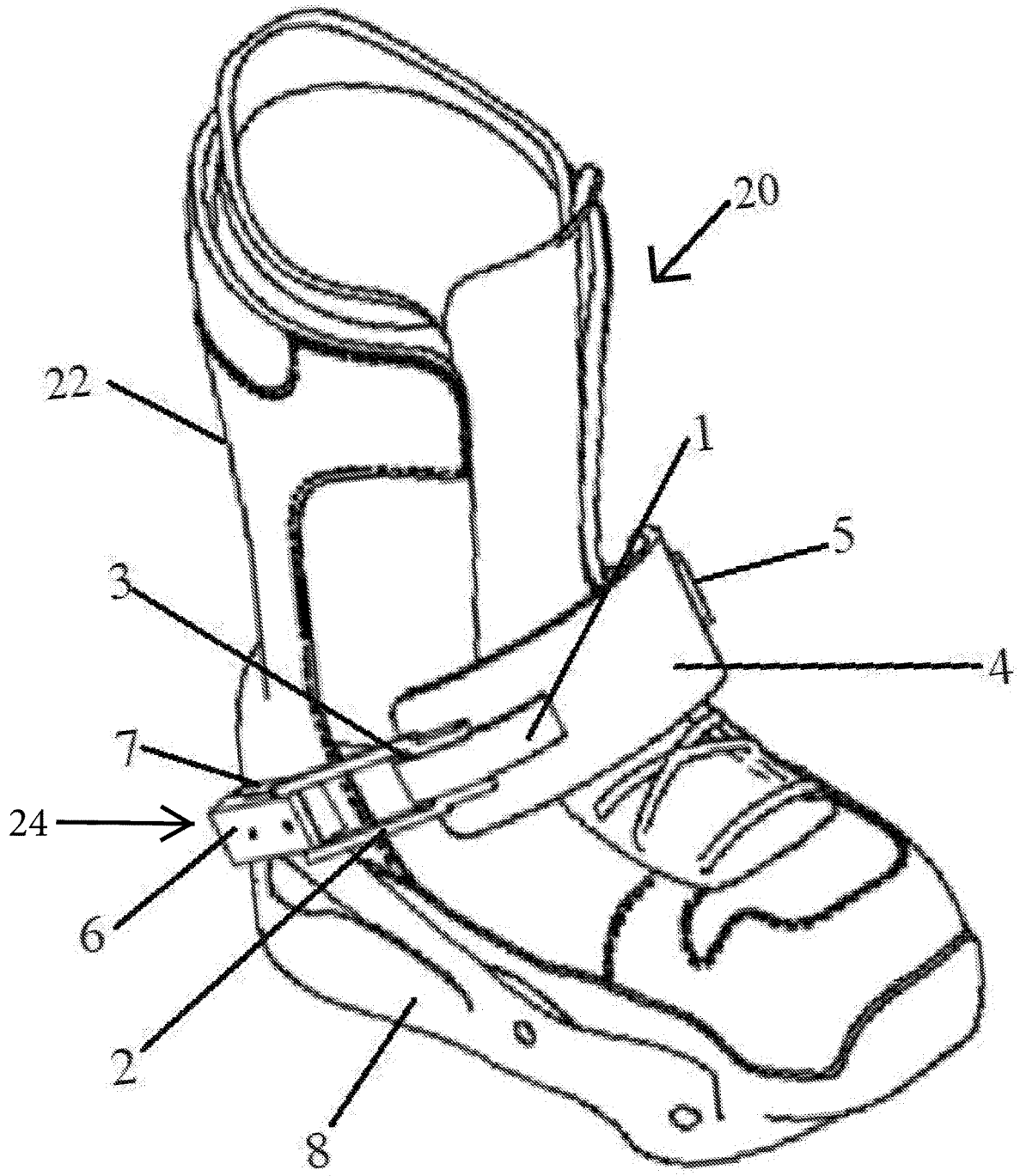
FIG. 1 is a perspective view of a boot secured to a self-aligning snowboard binding in accordance with an embodiment of the present invention.
Figure 2:
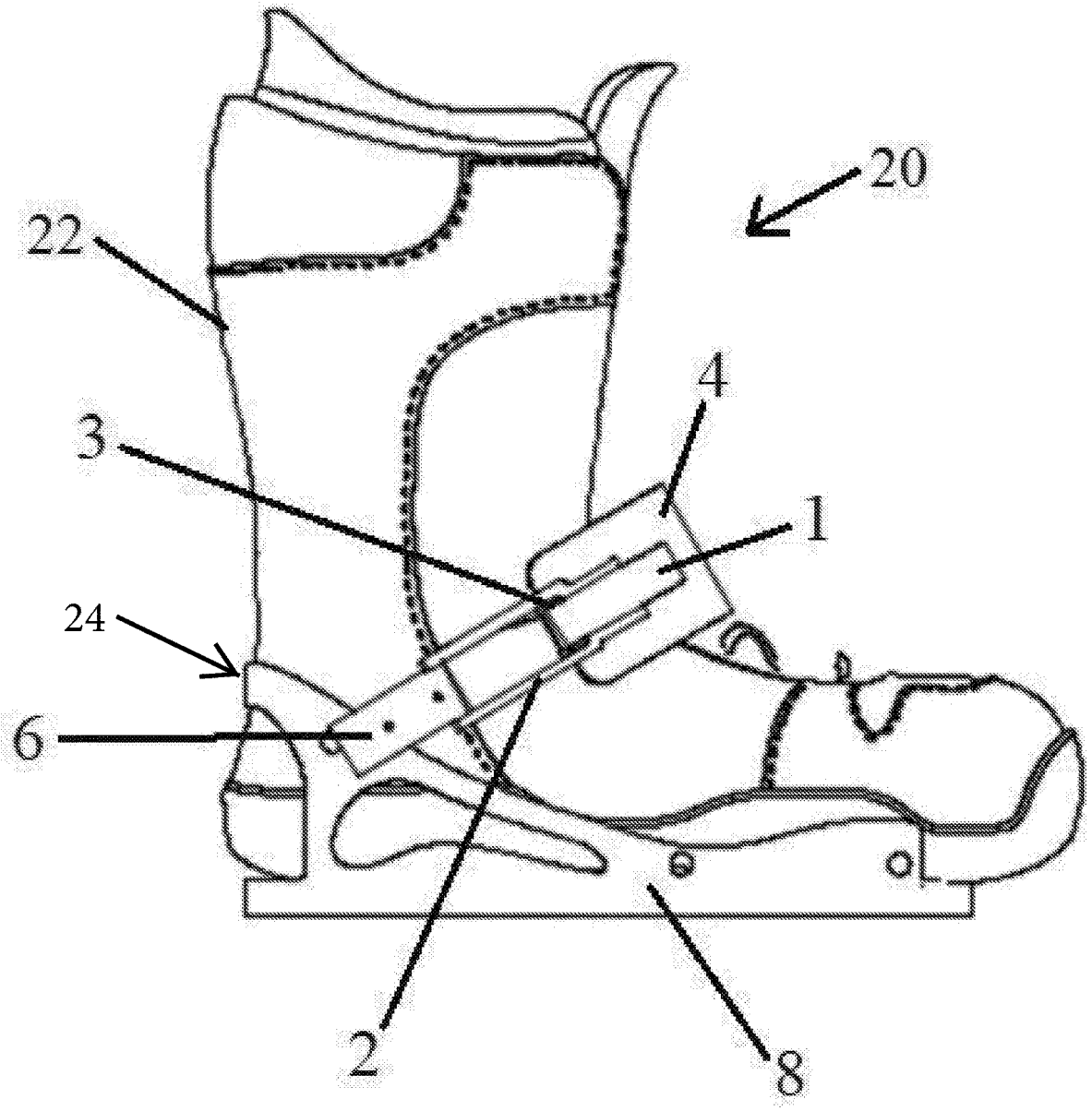
FIG. 2 is a side view of the boot secured to the binding.
Figure 3:
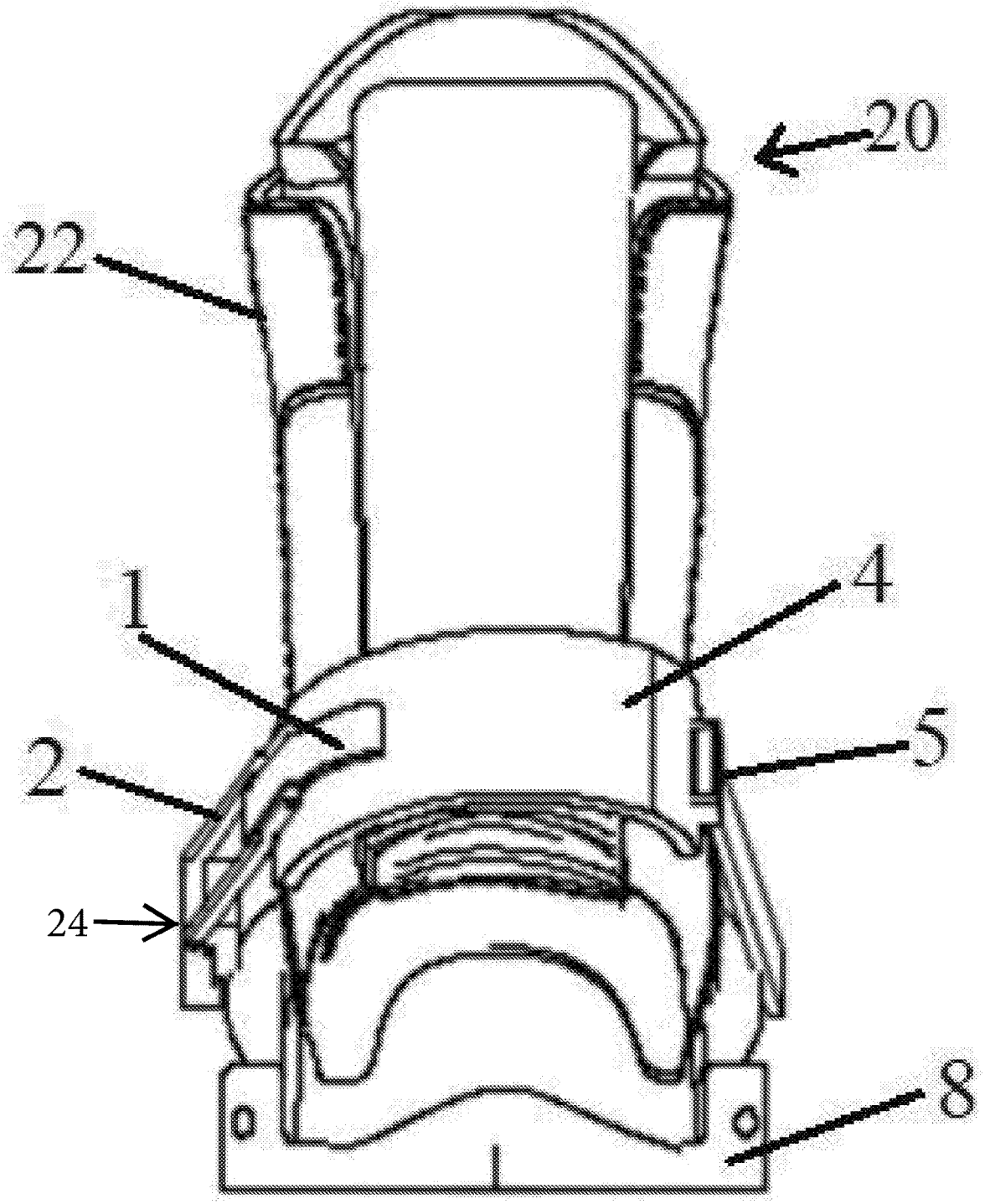
FIG. 3 is a front view of the boot secured to the binding.

In an embodiment, as depicted in FIGS. 1-3, a binding-boot assembly 20 includes a boot 22 secured in a binding assembly 24. The binding assembly includes a lever 1, a connector 2, a pivot point 3, a strap 4, an adjustable mechanism 5, a top magnetic clip 6, a bottom magnetic clip 7, and a baseplate 8. Lever 1 is used to tighten or loosen strap 4 around boot 22. When lever 1 is depressed, strap 4 tightens around boot 22; when lever 1 is raised, strap 4 loosens. Lever 1 is connected to pivot point 3 (as can be seen more clearly in FIG. 9) that is rigidly attached to strap 4 and is connected to connector 2. Connector 2 is connected to both lever 1 and top magnetic clip 6 with pin joints or another suitable mechanism. Bottom magnetic clip 7 is rigidly attached to baseplate 8 of the binding assembly. Adjustable mechanism 5 is attached rigidly to strap 4 and connects strap 4 to baseplate 8. In this way, adjustable mechanism 5 allows the user to change the length of binding strap 4. This allows the binding to be compatible with multiple boot sizes and for the user to adjust how tight strap 4 will be around boot 22 when lever 1 is closed.

Figure 4:
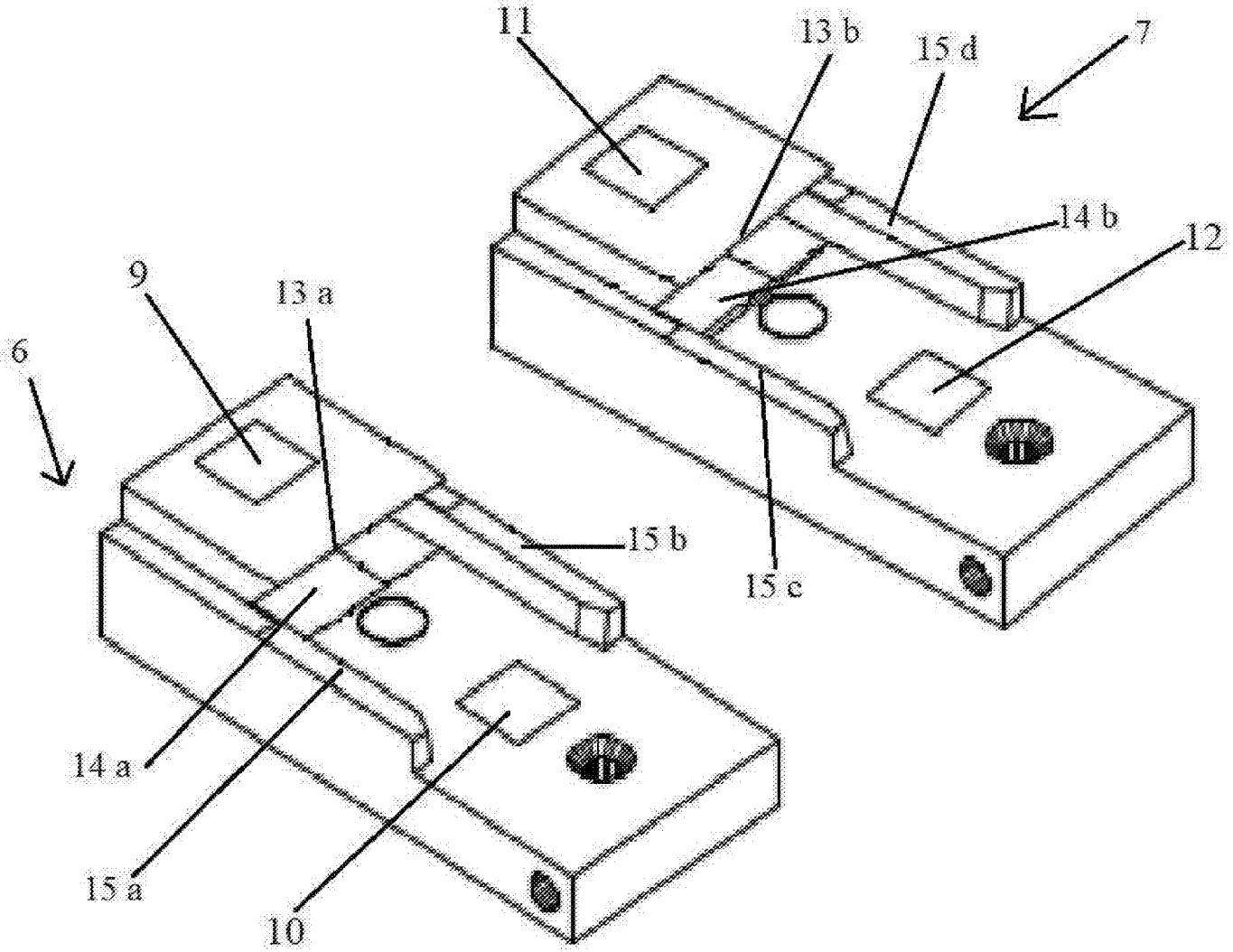
FIG. 4 is a perspective view of components of a magnetic buckle in accordance with an aspect of the present invention.
Figure 7B:
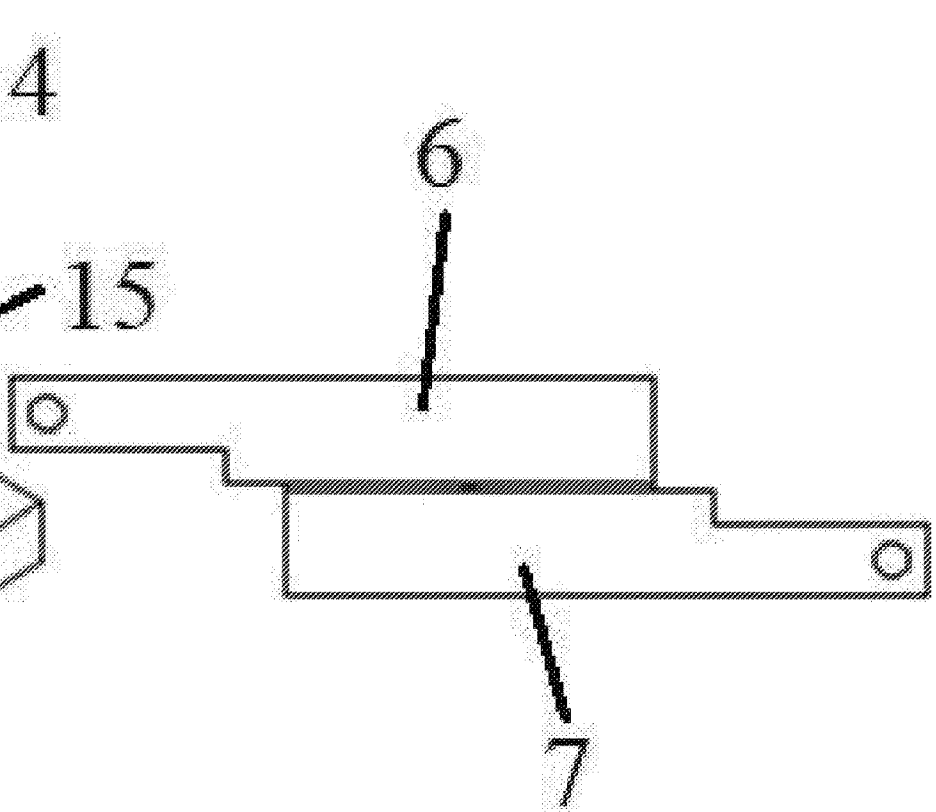
FIG. 7B is a side view of the components of the magnetic buckle after the buckle has been fully engaged.
Figure 7A:
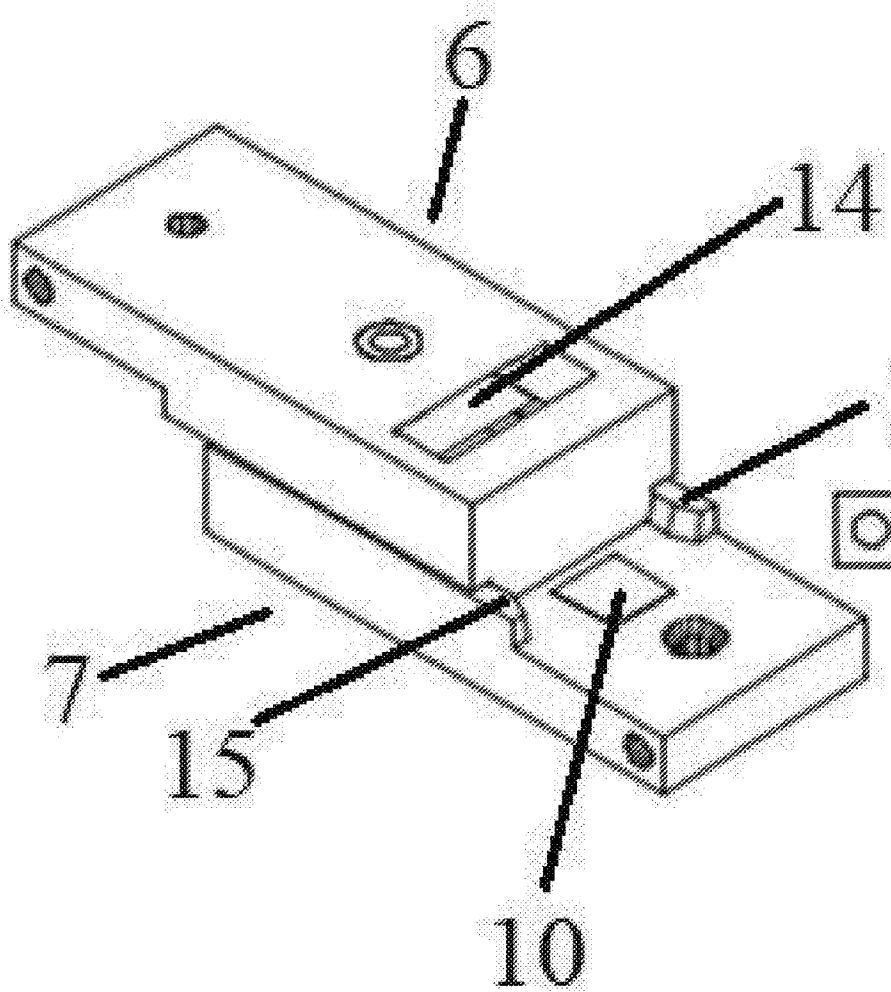
FIG. 7A is a perspective view of the components of the magnetic buckle after the buckle has been fully engaged.
Figure 8A:
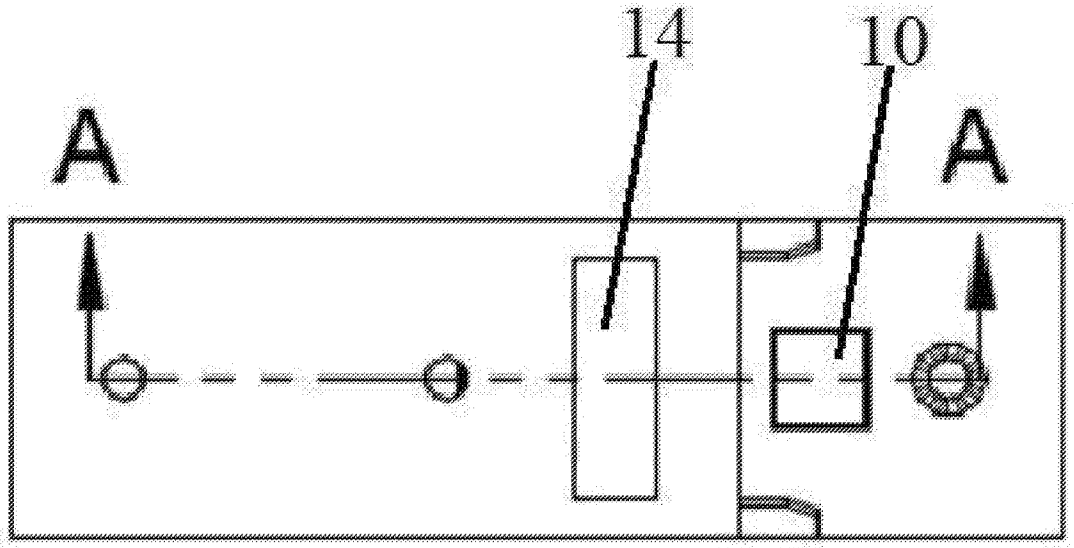
FIG. 8A is a bottom view of the magnetic buckle after the buckle has been fully engaged.
Figure 8B:
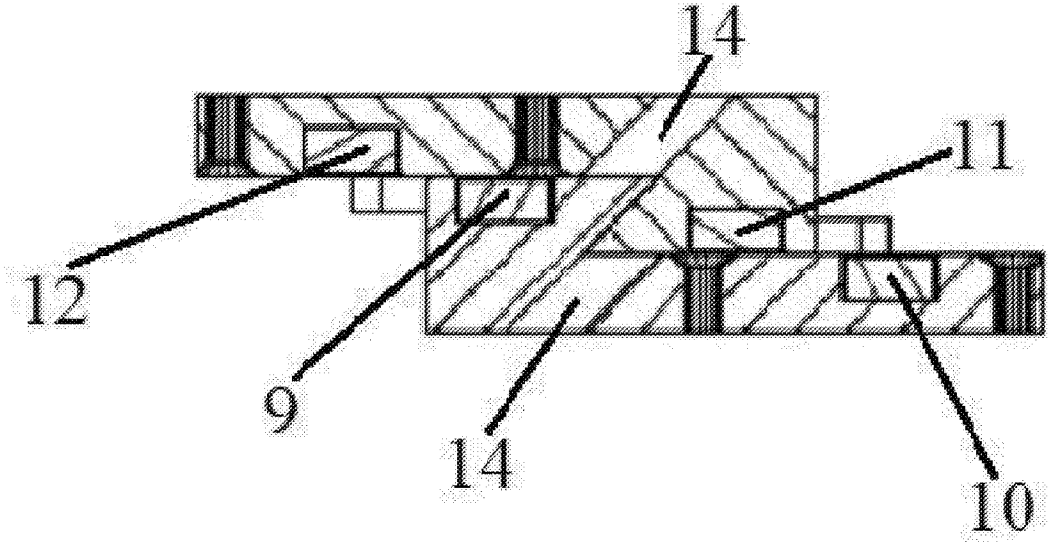
FIG. 8B is a cross section view of the magnetic buckle after the buckle has been fully engaged through line A-A.

Turning to FIG. 4, a pair of counterpart magnetic clips, a top magnetic clip 6 and a bottom magnetic clip 7 are depicted apart from the rest of binding assembly 24. Each of these magnetic clips contains two magnets imbedded into a front surface. Top clip 6 includes a first magnet 9 and a second magnet 10 while bottom clip 7 includes a third magnet 11 and a fourth magnet 12. Magnet 9 and magnet 11 have the "north" side facing upwards while magnet 10 and magnet 12 have the "south" side facing upwards. The purpose of the magnets is to draw the two clips together to form a loose buckle condition. A hooking portion 13 (e.g., 13*a*, 13*b*) is included on each of the clips and will draw top clip 6 and bottom clip 7 together due to magnetic attraction prior to full engagement. When the clips are fully engaged, two angled portions of hooking parts 13 fit together in a fashion such that the clips cannot be pulled apart. In a preferred embodiment, the angled portions have a 45 degree angle. A channel 14 (e.g., 14*a*, 14*b*) is an open area on each clip that passes through the clip to prevent snow from getting stuck inside, which could prevent the clips from fully engaging. When top clip 6 and bottom clip 7 engage, any snow that is inside the clips can be pushed out through channel 14. In certain embodiments, a wall 15 (e.g., 15*a*-15*d*) can protrude from each edge of the base of each clip. Walls 15*a*-15*d* make the clips resistant to separating from shear force. Walls 15*a*-15*d* also guide the clips when they transfer from the partially engaged state to the fully engaged state, as shown in FIGS. 7A-7B.

Figure 5B:
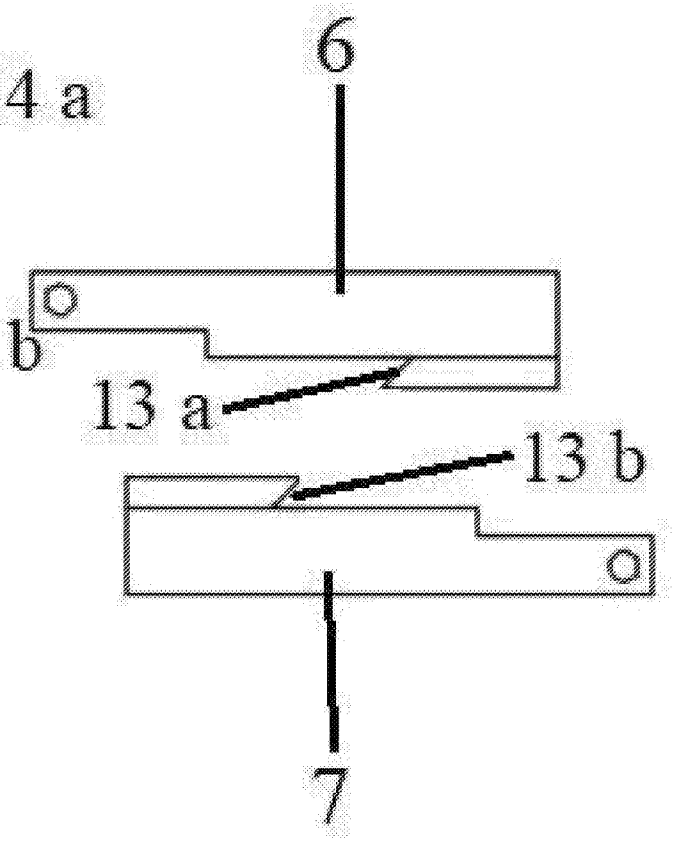
FIG. 5B is a side view of the components of the magnetic buckle aligned prior to engagement.
Figure 5A:
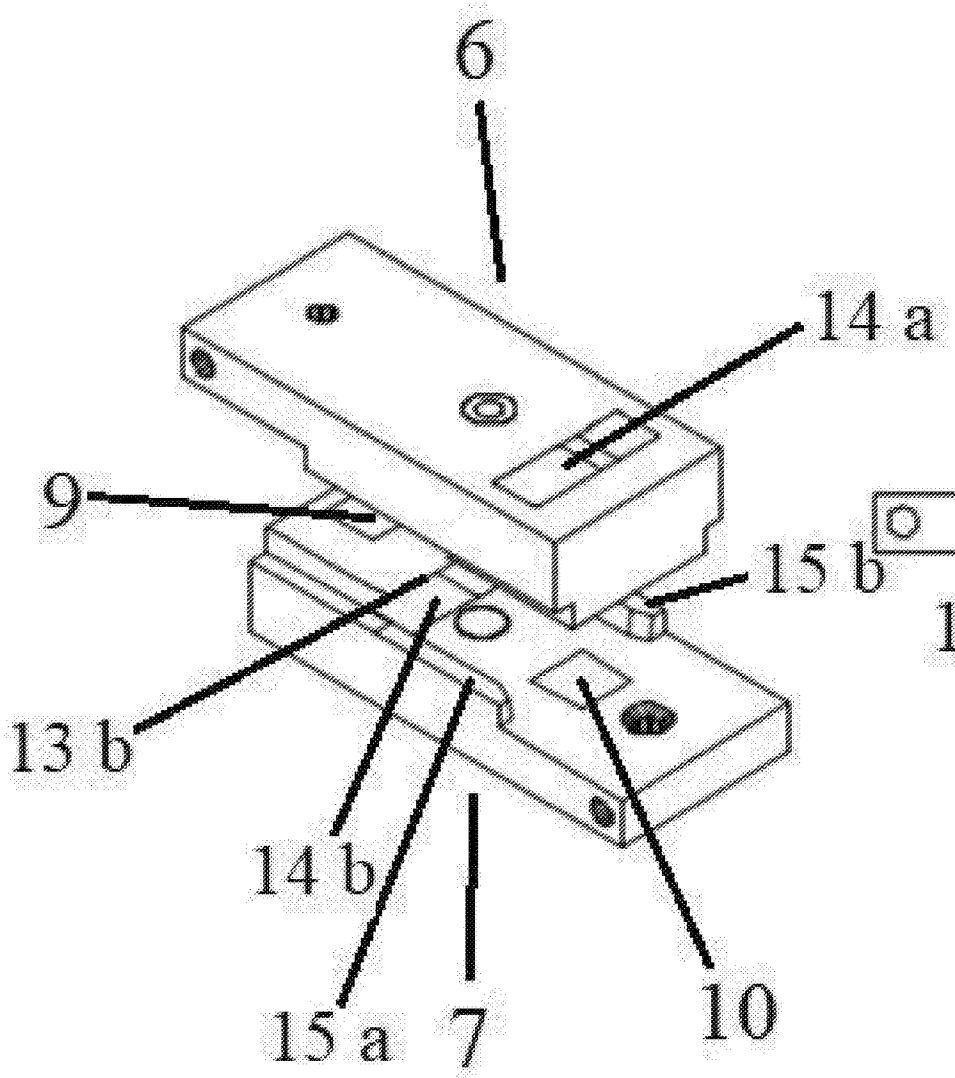
FIG. 5A is a perspective view of the components of the magnetic buckle aligned prior to engagement.

FIGS. 5A-8B detail three identified stages that take place as the clips are engaged when the user operates the binding. The positioning and alignment of magnets 9-10 in top clip 6 and magnets 11-12 in bottom clip 7 serve to assist with the proper alignment of top clip 6 and bottom clip 7 prior to full engagement. Magnet 9 and magnet 11 may have, for example, the "north" side of the magnets facing upwards while magnet 10 and magnet 12 have the opposite side, "south" in this example, facing upwards. With this configuration (or similar), when top clip 6 and bottom clip 7 are brought relatively close together, as shown in FIGS. 5A-5B, magnet 9 and magnet 12 are attracted to each other and magnet 10 and magnet 11 are attracted to each other.

Figure 6B:
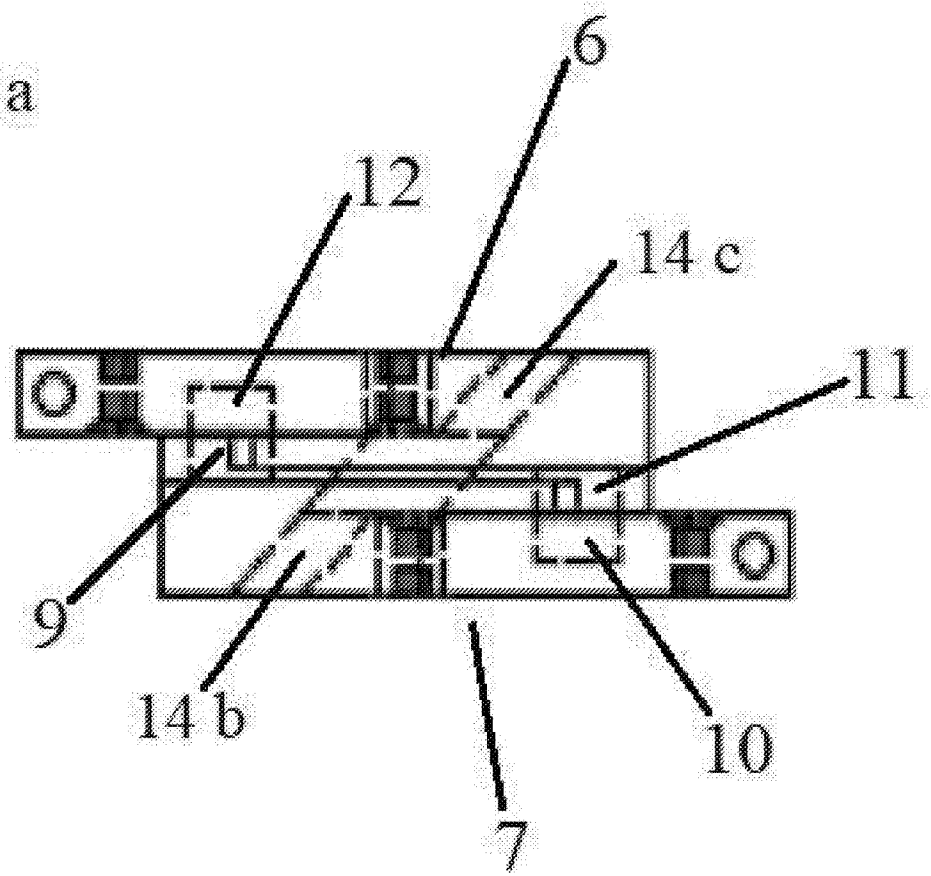
FIG. 6B is a side view of the components of the magnetic buckle after the initial engagement has been made.
Figure 6A:
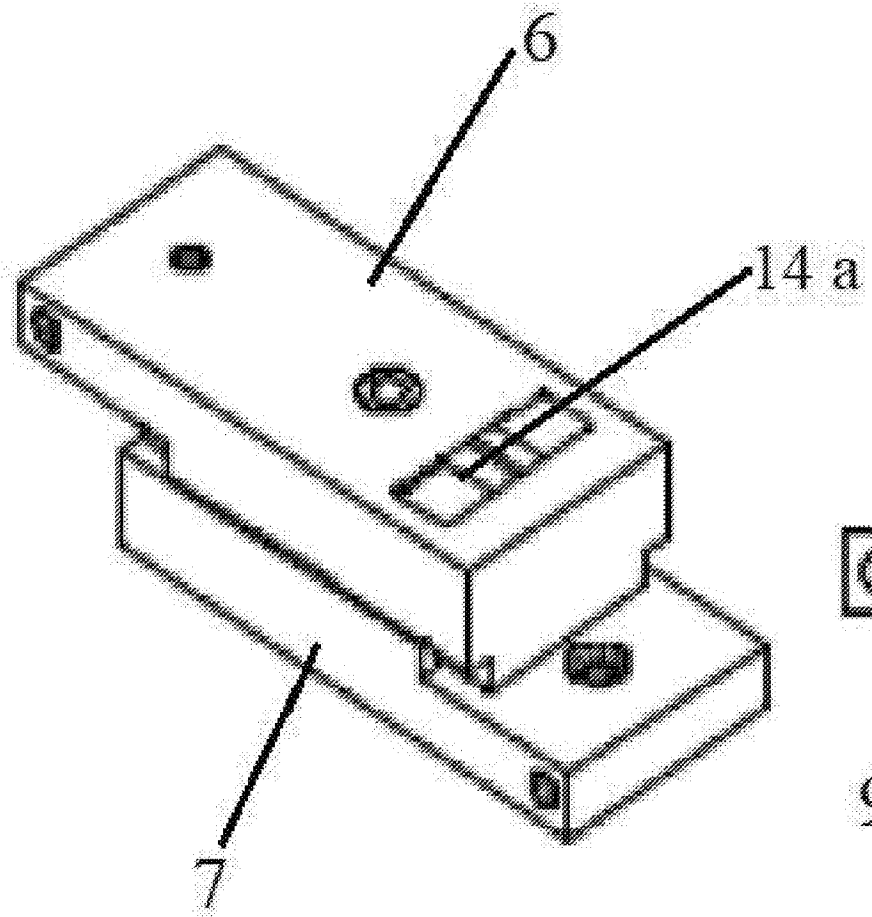
FIG. 6A is a perspective view of the components of the magnetic buckle after the initial engagement has been made.

When the magnets are drawn together, top clip 6 and bottom clip 7 will be partially engaged, as shown in FIGS. 6A-6B. This partial engagement occurs when the clips are brought close enough together (such as about an inch or less depending on the size and strength of the magnets) for the magnets to attract and pull top clip 6 into contact with bottom clip 7. In this position, the clips can be separated easily by applying a vertical force but are resistant to separating from shear force because of walls 15*a*-15*d*, which also guide the clips when they transfer from the partially engaged state to the fully engaged state.

Figure 9:
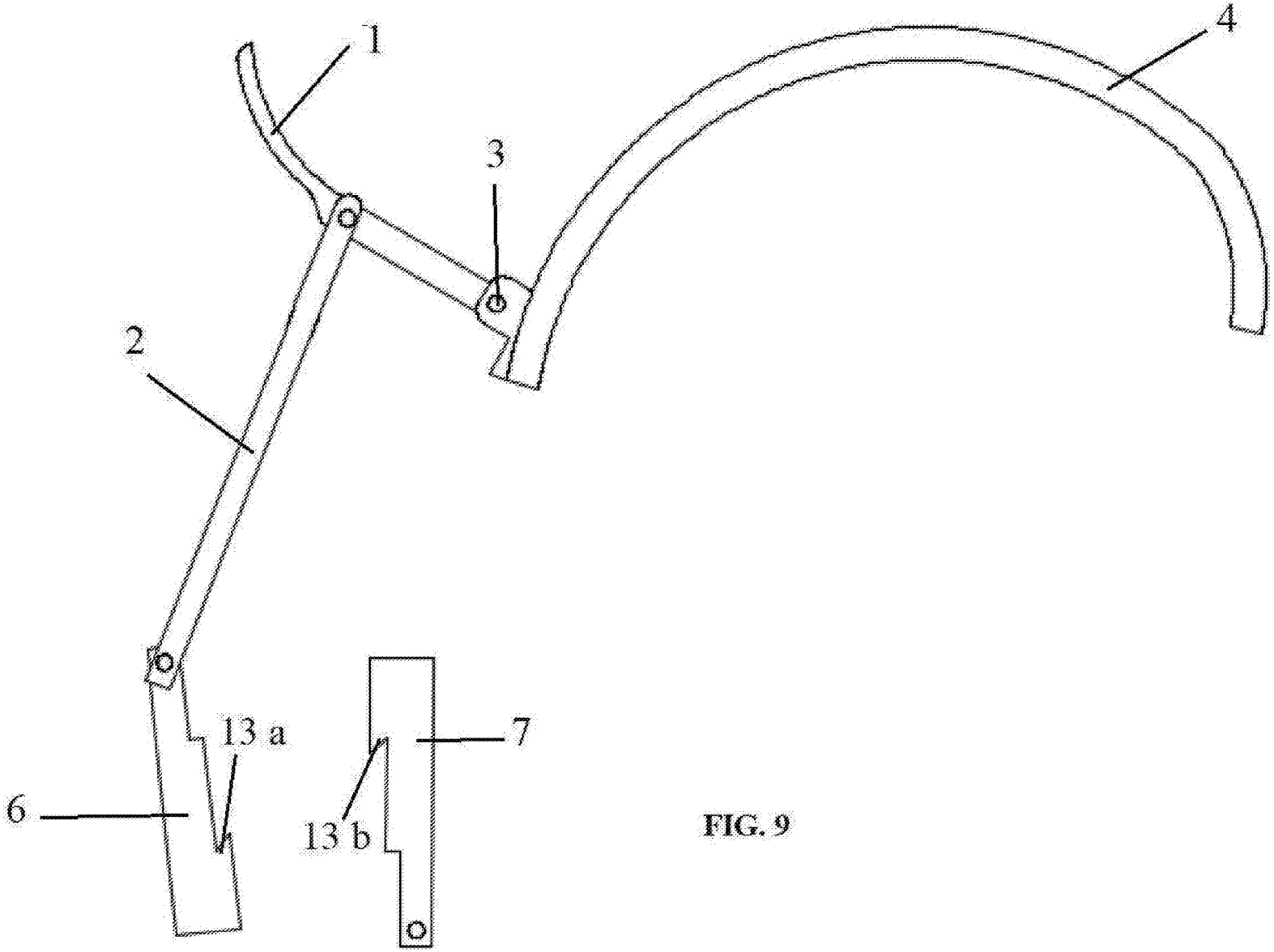
FIG. 9 is a side view of a buckle and lever assembly in the "unstrapped" or "open" position in accordance with an embodiment of the present invention.
Figure 10:
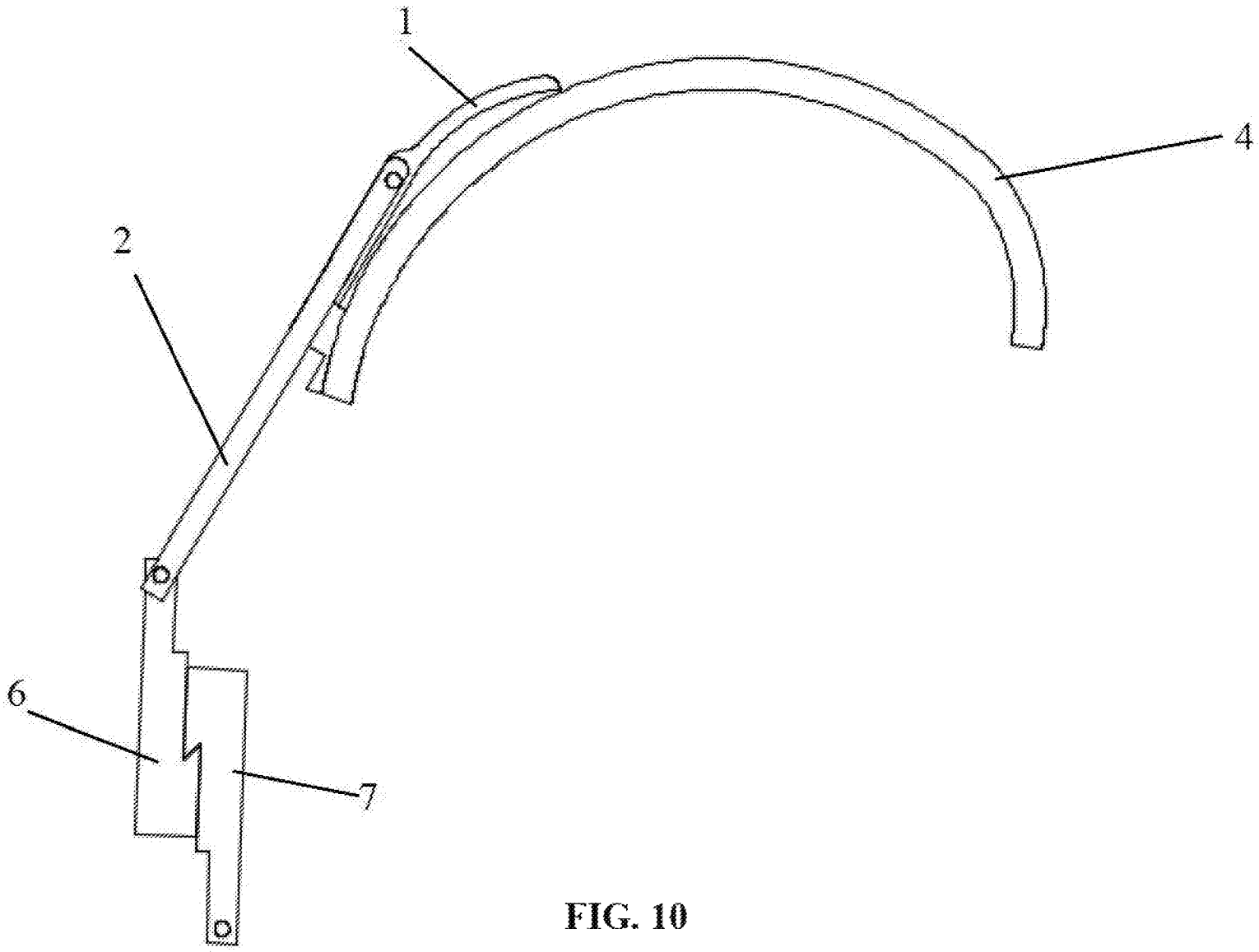
FIG. 10 is a side view of the buckle and lever assembly when in the "tightened" or "closed" position.

Top clip 6 and bottom clip 7 are shown in a fully engaged state in FIGS. 7A-8B. In this position, the clips hold firmly in place due to the tension created, such as when lever 1 or a similar mechanism is closed as illustrated in FIGS. 9-10. In the fully engaged state the clips are resistant to being separated by shear or vertical forces that may be applied. This resistance to separation is due in part to having a connection mechanism that is aligned when the magnets attract and fully engaged when opposing tensions are applied to each clip. For example, hooking portion 13*a* of clip 6 and hooking portion 13*b* of clip 7 interlock when in the binding is in the fully engaged position. The counterpart connection of hooking portions 13 is most clearly illustrated in FIG. 10. This allows the boot to be securely fastened to the board when opposing tension is applied to the clips, such as when lever 1 is engaged. The user can easily release boot 22 from the binding by releasing the opposing tension, such as by opening lever 1 and separating the clips. It will be understood that other suitable mechanisms may be used for applying tension, such as a ratchet or similar, and that other interlocking mechanisms may be used such as one or more aligned tongue and grooves.

The transition into the fully engaged state occurs when lever 1 is closed or when the binding is tightened in another fashion. This transition is shown in FIGS. 9-10, with FIG. 9 showing lever 1 open and FIG. 10 showing lever 1 closed and the clips in the fully engaged position.

As noted, FIG. 9 illustrates the clip, lever and strap system in the open position. In this position, the user is free to insert a boot into the binding because the clips have not been engaged and lever 1 is open, so strap 4 is loose. In FIG. 10, the binding is shown in the locked and tightened position. In this position, clip 6 and clip 7 are fully engaged and can only be separated if lever 1 is released. Strap 4 is also pulled tight around the user's boot. The closing of lever 1 as shown in FIG. 10 causes the clips to convert from the partially engaged position to the fully engaged position as mentioned above.

Figure 11:
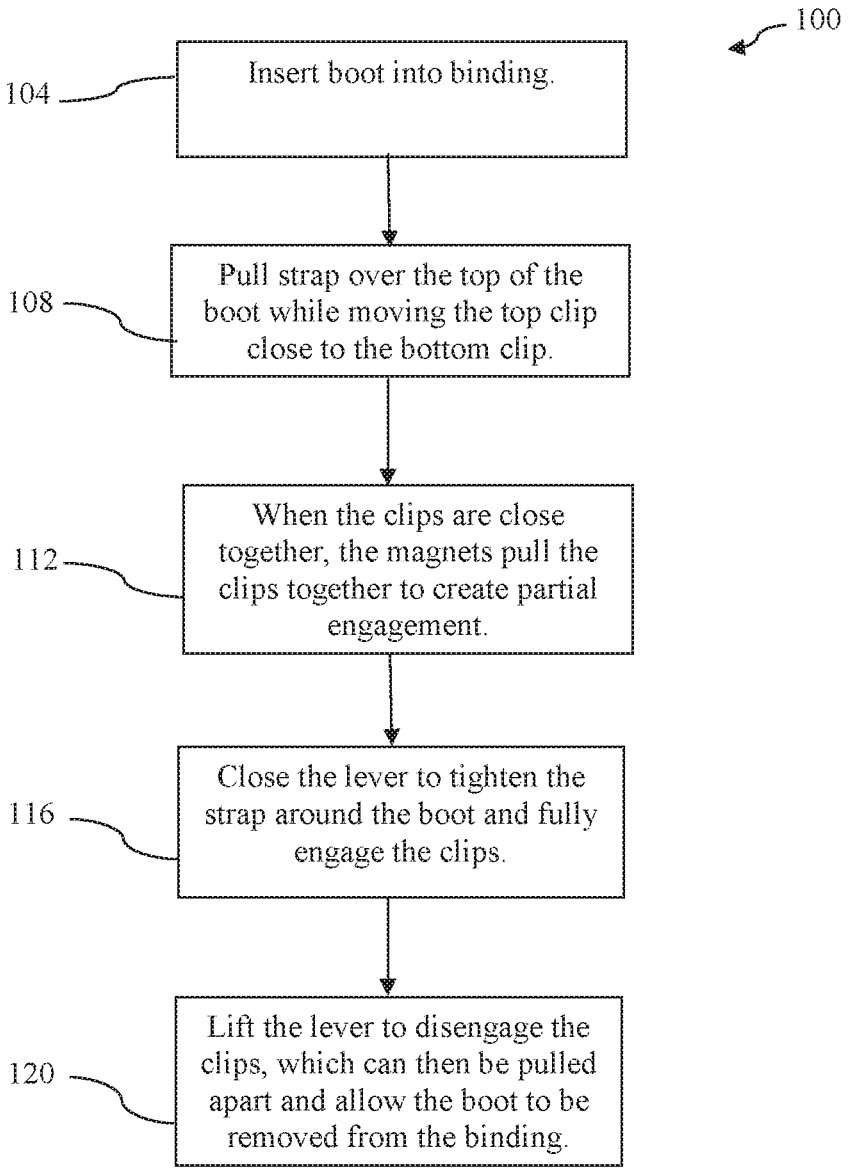
FIG. 11 is a process diagram outlining the steps of strapping in with a self-aligning binding in accordance with an embodiment of the present invention

Turning to FIG. 11, a self-aligning snowshoe binding process diagram 100 is shown. In operation, a user inserts a boot into the binding at step 104. The user then grabs a binding strap and pulls the strap over the top of the boot while simultaneously moving a first clip close to a second clip at step 108. When the clips are close enough together at step 112, magnets embedded in the clips will pull the two clips together and create partial engagement of the clips. Once the clips are partially engaged, the user places tension on the buckle at step 116. The tension causes the clips to engage fully, which allows the strap to be tightened around the user's boot. To release the boot from the binding, the user releases the tension at step 120 and disengages the magnetic clips. This is possible because when tension is removed, the clips return to the partially engaged position, and so can be easily separated. Once the clips are separated, the boot can easily be removed from the binding.

Exemplary embodiments have been disclosed above and illustrated in the accompanying drawings. It will be understood by those skilled in the art that various changes, omissions and additions may be made to that which is specifically disclosed herein without departing from the spirit and scope of the present invention.

What is claimed is:

1. A snowboard binding comprising:

a baseplate configured to receive a boot;

a first clip connected to the baseplate, the first clip having a first top face, a first front portion, and a first rear portion, wherein the first rear portion includes a first engagement member extending from the first top face, the first engagement member including a first hook portion, and wherein the first top face includes a first magnet having an outward facing polarity;

a second clip having a second top face, a second front portion, and a second rear portion, wherein the second rear portion includes a second engagement member extending from the second top face, the second engagement member including a second hook portion, the second hook portion configured to be an interlocking counterpart to the first hook portion, and wherein the second top face includes a second magnet, the second magnet having an outward facing polarity that is opposite the first outward facing polarity;

a tensioning mechanism connected to the second clip; and a strap connected to the tensioning mechanism and the baseplate.

2. The snowboard binding or claim 1, wherein the first magnet is embedded in the first front portion of the first top face and the first engagement member includes a third magnet having an outward facing polarity that is opposite of the first outward facing polarity.

3. The snowboard binding or claim 2, wherein the second magnet is embedded in the second front portion of the second top face and the second engagement member includes a fourth magnet having an outward facing polarity that is opposite of the outward facing polarity of the second magnet.

4. The snowboard binding of claim 3, wherein, when the first clip and the second clip are proximate each other and oriented such that the first top face is facing the second top face and the first rear portion is aligned with the second front portion and the first front portion is aligned with the second rear portion, the first magnet engages with the fourth magnet and the second magnet engages with the third magnet.

5. The snowboard binding of claim 4, wherein, when the first magnet engages with the fourth magnet and the second magnet engages with the third magnet, the first hook portion engages with the second hook portion.

6. The snowboard binding of claim 5, wherein tension is applied by the tensioning mechanism, the first clip and the second clip are held together by an interlocking engagement of the first hook portion and the second hook portion.

7. The snowboard binding of claim 1, further including a first open channel passing through the first clip and a second open channel passing through the second clip.

8. The snowboard binding of claim 1, wherein the first hook portion includes a sloped face angling toward the first top face and the second hook portion includes a second sloped face angling toward the second top face.

9. The snowboard binding of claim 1, wherein the tensioning mechanism is a lever.

10. The snowboard binding of claim 1, further including an adjustment mechanism configured to adjust tension between the baseplate and the strap.

11. The snowboard binding of claim 1, wherein the first top face includes a first edge and a second edge opposite the first edge, and wherein a first ridge extends from the first edge and a second ridge extends from the second edge.

12. A clip for a self-aligning snowboard binding buckle system, the clip comprising:

a base having a top face, a bottom, a front portion, and a rear portion, wherein an aperture passes through the base from the top face through the bottom;

an engagement member extending from the top face proximate the front portion, the engagement member including a first magnet and a hook portion; and a second magnet embedded in the rear portion of the top face, the second magnet having an outward facing polarity that is opposite of an outward facing polarity the first magnet.

13. The clip of claim 12, wherein the hook portion includes a slope from a top edge of the engagement member toward the top face, the slope angling downward from the top edge away from the rear portion of the base.

14. The clip of claim 13, wherein the slope is angled at about 45 degrees.

15. The clip of claim 14 further including:

a first ridge extending upwardly from a first edge of the top face; and a second ridge extending upwardly from a second edge of the top face.

16. A method of securing a boot to a snowboard comprising:

placing a boot onto a baseplate of a binding, the baseplate having a first magnetic clip;

pulling a strap over the boot, the strap having a second magnetic clip and a lever;

placing the first magnetic clip proximate the second magnetic clip so as to loosely couple the boot to the baseplate; and closing the lever so as to secure the boot to the baseplate.

* * * * *